US011110568B2

(12) United States Patent
Taylor et al.

(10) Patent No.: US 11,110,568 B2
(45) Date of Patent: Sep. 7, 2021

(54) CONVERTIBLE TWO STATION VISE

(71) Applicants: Chris Taylor, San Diego, CA (US); Steve Grangetto, San Diego, CA (US)

(72) Inventors: Chris Taylor, San Diego, CA (US); Steve Grangetto, San Diego, CA (US)

( * ) Notice: Subject to any disclaimer, the term of this patent is extended or adjusted under 35 U.S.C. 154(b) by 471 days.

(21) Appl. No.: 16/017,983

(22) Filed: Jun. 25, 2018

(65) Prior Publication Data

US 2019/0389036 A1 Dec. 26, 2019

(51) Int. Cl.
*B25B 1/24* (2006.01)
*B25B 1/10* (2006.01)

(52) U.S. Cl.
CPC ..... *B25B 1/2478* (2013.01); *B25B 1/103* (2013.01); *B25B 1/2452* (2013.01); *B25B 1/2484* (2013.01); *B25B 1/2489* (2013.01)

(58) Field of Classification Search
CPC .. B25B 1/02; B25B 1/10; B25B 1/103; B25B 1/24; B25B 1/2405; B25B 1/2452; B25B 1/2473; B25B 1/2478; B25B 1/2484; B25B 1/2489; B25B 5/00
USPC ..... 269/43, 54, 136, 154, 166, 244
See application file for complete search history.

(56) References Cited

U.S. PATENT DOCUMENTS 1,549,278 A 8/1925 Sundstrand
3,834,435 A 9/1974 McCord, Jr.
4,251,066 A 2/1981 Bowling
4,429,887 A 2/1984 Smith
4,934,674 A * 6/1990 Bernstein ..... B25B 1/103 269/136
5,098,073 A 3/1992 Lenz
5,535,995 A 7/1996 Swann et al.
5,623,757 A * 4/1997 Durfee, Jr. ..... B23Q 3/102 269/136
5,735,513 A 4/1998 Toffolon
6,957,809 B1 10/2005 Ferrara et al.
8,020,877 B2 9/2011 Lang
8,158,242 B2 4/2012 Nishihata et al.
8,256,753 B2 9/2012 Teo
8,322,699 B2 12/2012 Prell et al.
9,364,937 B2 * 6/2016 Taylor ..... B25B 1/24
2010/0219573 A1 9/2010 O'Rell et al.
2012/0068393 A1 3/2012 Van de Vosse et al.
2013/0270760 A1 10/2013 Gordon
2018/0272499 A1 * 9/2018 Cheng ..... B25B 1/02

* cited by examiner

*Primary Examiner* — Lee D Wilson
*Assistant Examiner* — Robert F Neibaur
(74) *Attorney, Agent, or Firm* — Mark Wisnosky

(57) ABSTRACT

A two-station self-centering vise to hold a pair of work pieces is described. The pieces are held in place against a centered fixed jaw, being clamped against the centered fixed jaw by a pair of movable jaws located on either side of the centered jaw and that simultaneously move toward or away from the centered jaw on actuation of a lead screw. The vise may be converted to a single station vise by removable of the fixed center jaw. A spring loaded, adjustable, friction pad attached to the base of one of the two movable jaws enables temporary clamping of a first work piece while the second workpiece is being installed and once both workpieces are in place the lead screw is turned further to securely and accurately hold the workpieces in between the movable jaws and the fixed central jaw.

1 Claim, 6 Drawing Sheets

CONVERTIBLE TWO STATION VISE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Technical Field

The present invention relates to a two station tooling fixture that may be converted to a single station tooling fixture. The tooling fixture is used for accurately fixing a workpiece on a worktable for machining.

Related Background Art

A tooling fixture is used to hold a workpiece during intricate machining such as 5 axis machining. The fixture system requires that the workpiece be held securely and precisely and provides access to a machine tool to all facets of the workpiece. Preferably it is possible to prepare the raw stock and easily and removably mount the stock in the fixture to present to a machine to create a part. Self-centering vises are known, which comprise a body, an externally threaded lead screw that is mounted rotatably about its longitudinal axis, and two sliding blocks screwed onto the threaded spindle and containing clamping surfaces to engage the workpiece. The productivity of a tooling machine can be improved if more than one work piece can be mounted to the work table at a time. But there are also times when a single station tooling fixture is required, such as when tooling a larger workpiece. There is a need for a multiple station tooling fixture that can be converted between a two station tooling fixture and a single station tooling fixture, without the need to remove the tooling fixture from the table of the tooling machine.

There are many instances, however, when two blocks of material are to be machined simultaneously. There are also times when a single station is required. Efficiency is improved if the same vise can be used both for two stations and for a single station application. There is a need for a convertible two station vise.

A tooling fixture that provides a self-centering two station vise to hold a pair of work pieces is described. The design provides a means to allow a precision centering adjustment of the clamping surfaces that is integrated into the central support structure for the threaded spindle. The same vise base can also be used as a single station vise by incorporating a removable center boss screw.

BRIEF DESCRIPTION OF THE DRAWINGS

Features are numbered equivalently through all drawings.

DETAILED DESCRIPTION OF THE INVENTION

Figure 1:
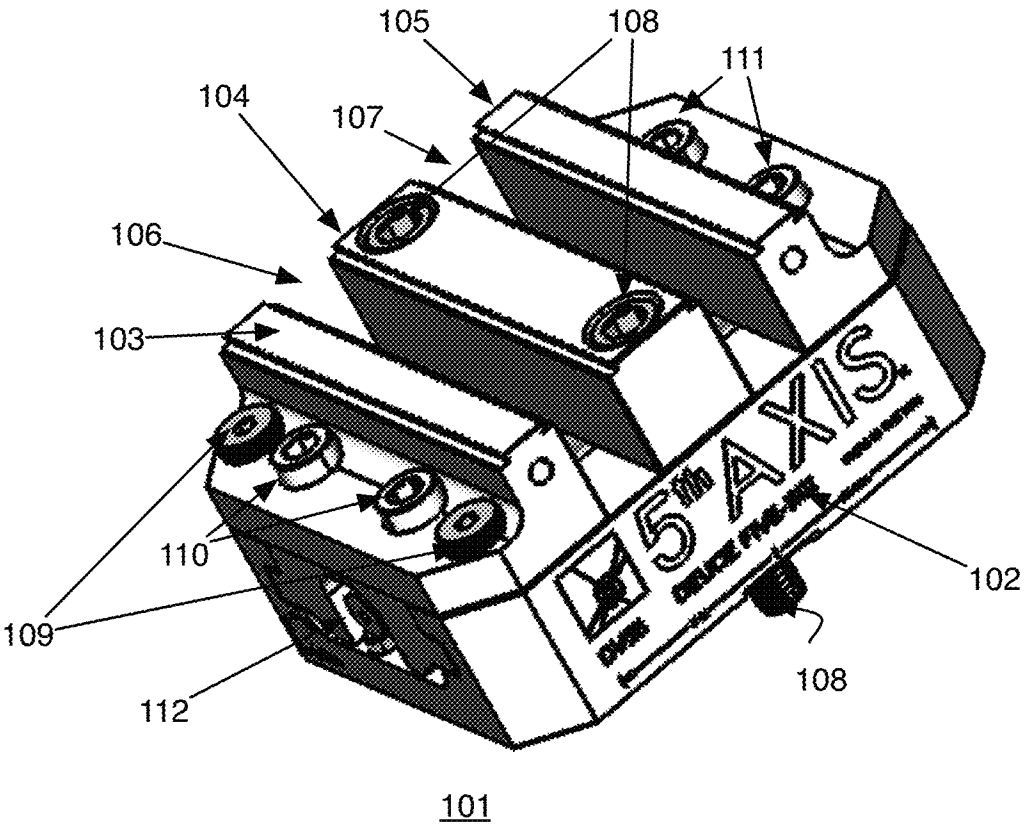
FIG. 1 is a top perspective view of an embodiment of the tooling fixture.

The numbering of parts is consistent between drawings. Referring to FIG. 1, a tooling fixture is shown. The tooling fixture 101 comprises a base 102 to which is attached a right hand jaw 103, a left hand jaw 105 and a fixed center jaw 104. The right hand jaw and the left hand jaw are attached, using shoulder bolts 110, 111, to separate movable trucks (not visible) which are each in turn attached to a lead screw 112. When used as a two station tooling fixture, the right hand jaw, left hand jaw, trucks and lead screw are all movable within the base 102. The center jaw 104 is fixed to the base 102 with lead screws 112. The vise may be converted to a self-centering single station vise by unbolting the shoulder bolts 108 that hold the center jaw, removing the center jaw from the base 102 and locking one of the two movable jaws, in the Figure the right hand jaw 103, in place using tooling pins (visible in later Figures) and bolts 109. The jaw that is fixed in position relative to the base 102 and also thereby indexes the position of the workpiece clamped between the right hand and left hand jaws relative to the base 102 and therefore relative to the milling machine surface to which the base is fixed using bolts 108. With the center jaw 104 in place as shown, the tooling fixture 101 provides for two cavities 106, 107 that may be used for clamping a workpiece between the movable jaws 103, 105 and the center jaw 104 by rotation of the lead screw 112. Note that when used as a two station vise the bolts 109 are removed to allow the right and left hand jaws to both move relative to the center jaw 104. The right hand jaw 103 and truck include a pair of friction plates (not visible in this Figure) that provide an adjustable resistance such that as the lead screw 112 is turned the left hand jaw 105 first moves towards the center jaw 104 until the workpiece in the left hand cavity 107 is held between the left hand jaw 105 and the center jaw 104. Continued turning of the lead screw 112 cause the right hand jaw 103 to begin moving towards the center jaw 104 once the clamping force between the left hand jaw 105 and the center jaw 104 exceeds the frictional force between the friction plates and the base 102. The friction plates are spring loaded and the force is adjustable using the adjustment screws located underneath the right hand jaw and truck visible in later Figures. Once the right hand jaw begins moving towards the center jaw 104 workpieces (not shown) will be firmly clamped in both cavities 106, 107 and held firmly in place against the fixed center jaw 104. The base is typically bolted to the table of a milling machine and indexed to the milling machine using tooling alignment pins (visible in subsequent drawings).

Figure 2:
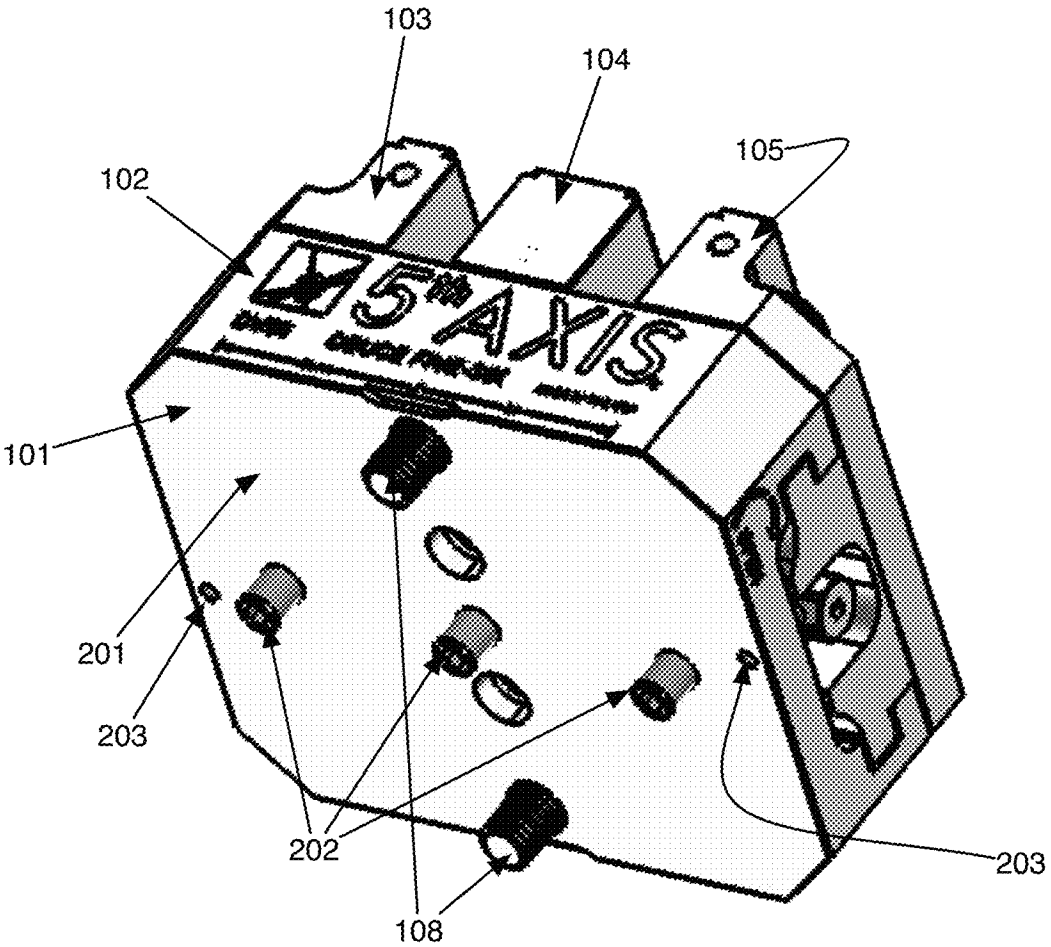
FIG. 2 is a bottom perspective view of the tooling fixture of FIG. 1.

FIG. 2 shows a bottom view of the two station vise 101. The numbering of parts in all Figures are consistent such that the parts already described in FIG. 1 may be shown only for reference in FIG. 2. Protruding from the bottom 201 of the base 102 are the tooling alignment pins 202 that are used to align the tooling fixture 101 to the work surface of the milling machine (not shown).

Figure 3:
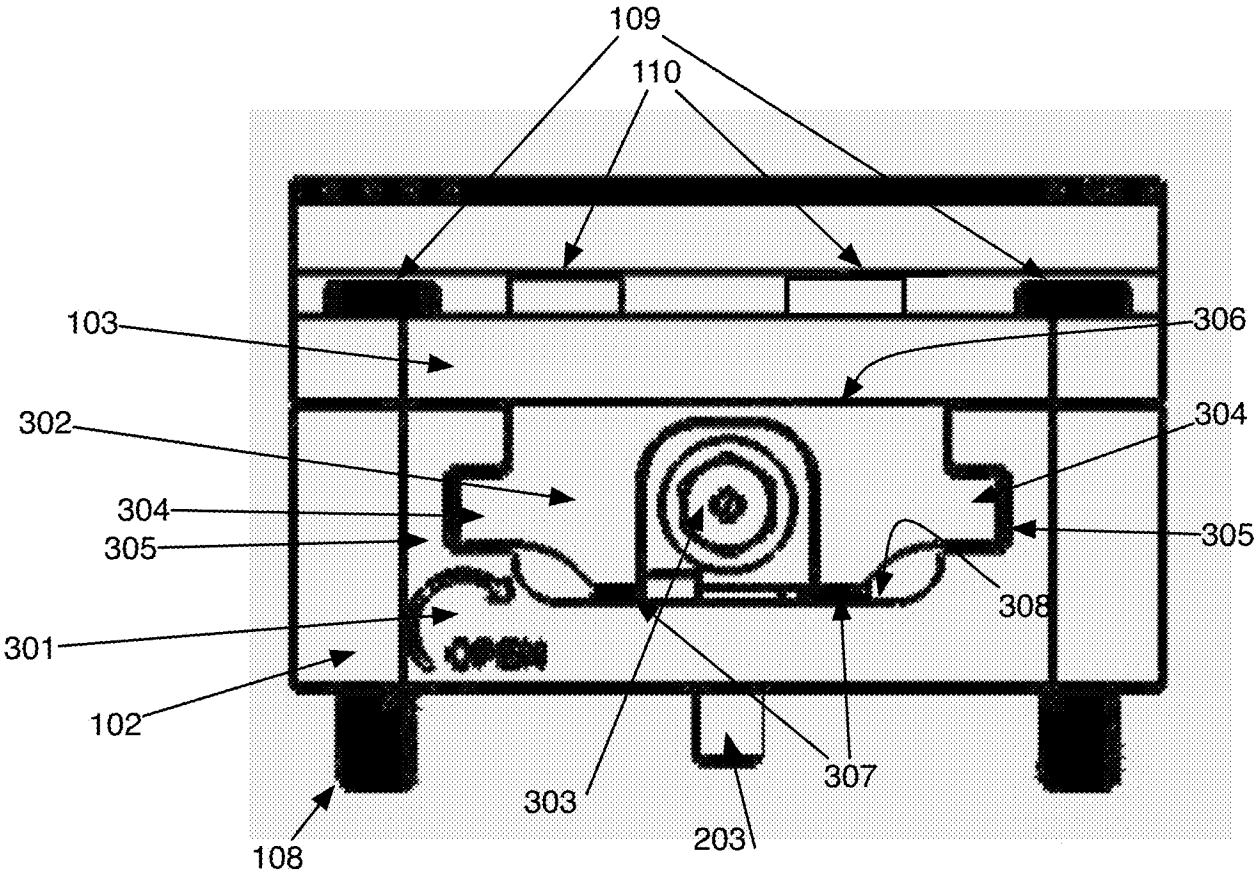
FIG. 3 is right side view of the fixture of FIG. 1.

FIG. 3 shows an end view of the right hand jaw 103. The jaw is attached to a truck 302 using the jaw bolts 110. The bolts 109 are optionally used to lock the right hand jaw in place when the jaw is converted to a single station tooling fixture. The vise could equivalently be constructed where the left hand jaw is locked in place upon conversion by fashioning the left hand jaw and truck in the manner that the right hand jaw and truck are shown in the examples. The jaws are moved by turning the head 303 of the lead screw. The lead screw is threaded and fits through threaded holes (not visible in this Figure) on the truck 302 such that turning of the head of the lead screw caused the movement of the truck along the length of the lead screw. Opening the jaws is accomplished by rotation in the direction shown 301. In another embodiment, the vise is constructed by reversing the threads on the lead screw such that turning in the direction shown 301 would result in closing the jaws. Also seen in the figure are the bolts 108 used to attach the vise to the work surface of a milling machine and the tooling alignment pins 202. The truck 302 is comprised of a top surface 306 to which the jaw 103 is bolted using the bolts 110. The sides of the truck 302 include protrusions 304 that fit within grooves 305 that are cut in the inside walls of the base 102. The protrusions 304 and the grooves 305 are sized such that the truck may slide along the length of the base 102, which in the FIG. 3 would be movement in and out of the plane of the Figure as shown. Friction blocks 307 can be seen attached to the bottom surface of the truck 302. The friction blocks 307 are adjustably spring loaded using cup screws (not visible in the Figure) that screw into threaded holes (not visible) in the top surface 306 of the truck and exert pressure upon springs that in turn push against the friction blocks 307 against the interior top surface 308 of the base 102.

Figure 4:
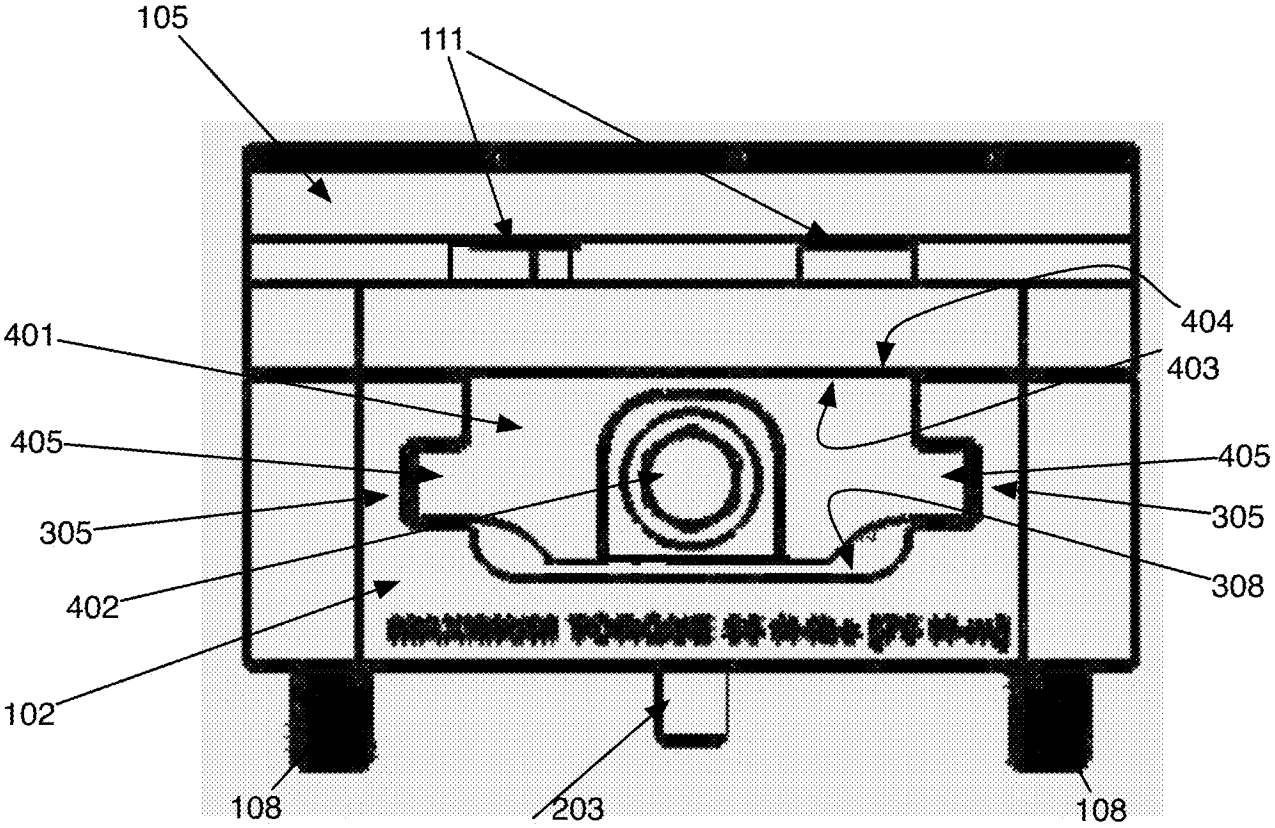
FIG. 4 is a left side view of the fixture of FIG. 1.

FIG. 4 shows a view of the left hand end of the vise. The bottom surface 403 of the left hand jaw 105 is bolted to the top surface 404 of the left hand truck 401 using the bolts 111. The truck 401 includes protrusions 405 on either side that are shaped and size to fit within the grooves 305 within the base 102. The truck is moved by turning the hex nut head 402 of the lead screw. Note that both trucks of FIGS. 3 and 4 are moved simultaneously by turning either the head 402 or the head 303 on the opposite end of the vise shown in FIG. 3. The threads on the lead screw fit within a threaded hole (not seen) on the left hand truck 401 behind the lead screw head 402. Rotation of the lead screw by rotation of the lead screw head 402 causes the threads on the lead screw to mesh with those in the threaded hole on the truck 401 and causes the truck to move along the groove 305. Movement of the truck 401 and the attached jaw 105 is into and out of the page of the FIG. 4. Also seen in the Figure are the tooling alignment pins 202 and the bolts 108 use to attach the vise to the surface of a milling machine (not shown).

Figure 5:
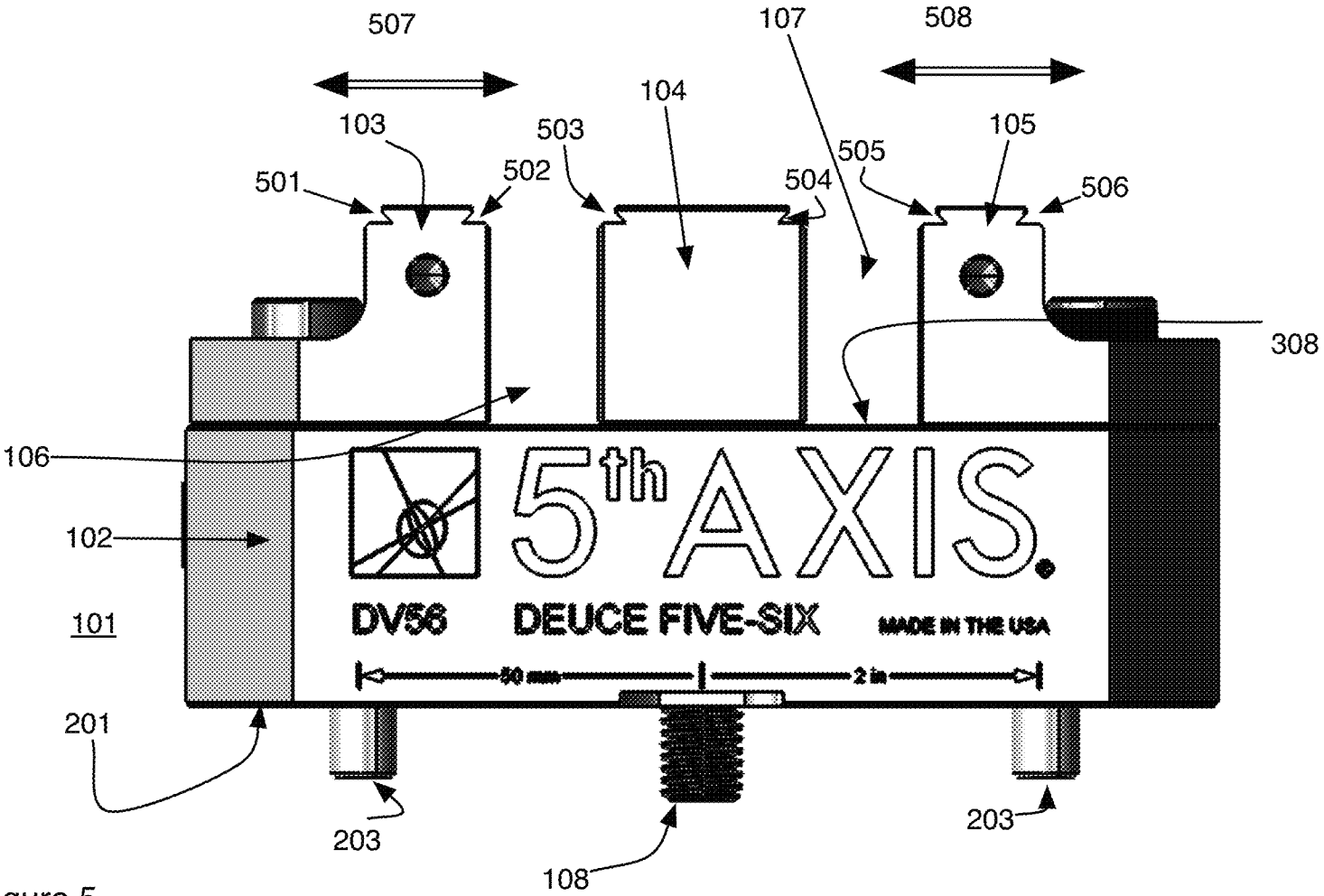
FIG. 5 is a front side view of fixture of FIG. 1.

FIG. 5 shows a side view of the same two station convertible vise 101 as seen in all other Figures. The vise 101 is comprised of a base 102 has a top surface 308 and a bottom surface 201. In use, the base is attached to the tooling bed of a milling machine (not shown) using the bolts 108. The base location is registered using removable tooling pins 202. A fixed center jaw 104 is removably attached to the top surface of the base 102. "Fixed" meaning that once attached the center jaw does not move through manipulation of the lead screw (seen in other Figures). The vise is also comprised of a first (or left hand) movable jaw 103 and a second (or right hand) movable jaw 105. Turning off the lead screw causes the jaws 103, 105 to move in the directions 507, 508 relative to the center jaw 104 thereby opening or widening or closing the spaces 106 between the movable jaws 103, 105 and the center jaw 104. In a preferred embodiment workpieces to be machined are clamped between the jaws 103, 105 and the center jaw 104, in the spaces 106, 107, by fitting dovetail protrusions on the workpieces into the dovetail grooves 502, 503, 504, 505 on the jaws 103, 140, 105. The movable jaws 103, 105 further include a second set of dovetail grooves 501, 506 on their outer edges such that workpieces that are constructed with an inner facing dovetail projection may be clamped by moving the movable jaws outward rather than inward. The movable jaws are also both L-shaped and can be mounted as shown or flipped around thereby providing a wider opening for a larger workpiece. When flipped around the second set of dovetail grooves 501, 506 are used to clamp the workpiece between the movable jaw and the center fixed jaw 104.

Figure 6:
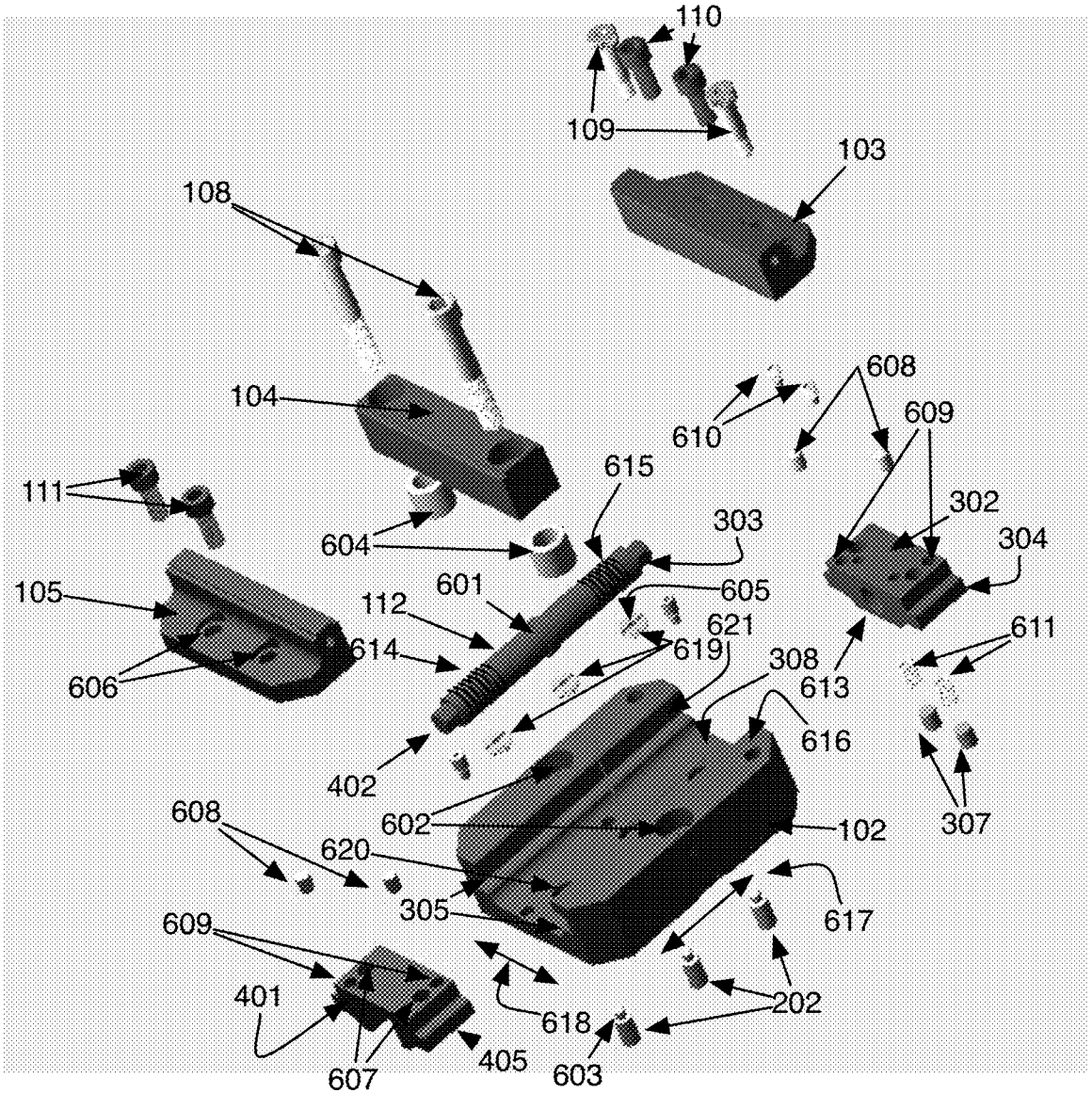
FIG. 6 is an exploded view of the fixture of FIG. 1.

FIG. 6 shows an exploded perspective view of the two station convertible vise. The vise is comprised of a base 102. The base has a rectangular shape with a long axis 617 and a short axis 618. The short axis is perpendicular to the long axis. The base further includes a central U-shaped cavity 620 along the length of the base and parallel to the long axis 617. The U-shaped cavity includes vertical walls 621 (only one wall labeled) and grooves 305 cut in the vertical walls. The protrusions 304 on the truck 302 fit within the grooves and the truck moves in the direction of the long axis 617 by sliding of the protrusion 304 in the grooves 305. Movement of the trucks 302 is controlled by the lead screw 112. The lead screw 112 is a cylinder with a long axis positioned parallel to the long axis 617 of the base 102. The lead screw is threaded with left handed threads 614 at one end and right handed threads 615 at the other end. The lead screw fits within holes 613 on the trucks 302 (only the right handed truck and hole is labeled due to space constraints in the Figure). The holes 613 are threaded to match the corresponding threads on the lead screw. In the figure shown the threads 615 on the lead screw 112 are right handed threads as are the threads in the hole 613 on the truck. Rotation of the lead screw causes the truck 302 to move along the length of the lead screw. In the assembled vise rotation is accomplished by rotating one of the two hexagonal nuts 303, 402 located at either end of the lead screw. The left and right handed threads 614, 615 on the lead screw are separated by a stop 601 at the center of the lead screw. The stop 601 is a raised cylindrical region on the lead screw such that the truck is stopped from further movement when the lead screw is rotated such that the truck moves towards the center of the lead screw to the point of abutting against the stop 601. The right 103 and left 105 jaws are mounted to the trucks 302, 401 using screws 110, 111 that fit through holes 606 on the jaws and screw into threaded holes 607 on the trucks. Alignment of the jaws with the trucks is accomplished using tooling pins 608 that fit into tooling holes 609 located on the trucks 302, 401. When the center jaw 103 is removed and the vise is used as a single station fixture, the right hand jaw 103 is locked into place at the end of the base 102 by fitting bolts 109 through the jaw 103 and screwing into the holes 616 in the base 102. The removable center jaw 104 is aligned with the base 102 using bushings 604 that fit into tooling holes 602. The screws 108 are further used to hold the base 102 to the bed of a milling machine as already discussed above. The base is aligned with bed of a milling machine through use of a plurality of tooling pins 202. The tooling pins are fit to the base using threaded inserts 619. The threaded inserts are discs that are threaded on their outside edges to fit into threaded holes in the base 102 and further include a central threaded hole 605 into which threaded protrusions 603 on the pins 202 are fit. When the vise is used as a dual station fixture the fixing bolts 109 are removed and the right hand truck can move along the direction of the long axis 617 of the base 102. The movement of the right hand truck is restricted by the drag of the friction plates 307 on the top surface 308 of the U-shaped cavity 620. Restriction of the movement of the right hand truck 302 and attached jaw 103 results in a first part (not shown) to be machined being first clamped between the freely moving left hand jaw 105 and the central jaw 104 and held in place while a second part to be machined (not shown) may then be inserted between the right hand jaw 103 and the central jaw 104. Further rotation of the lead screw 112 results in parts being securely held between both the right hand jaw and the left hand jaw and the center jaw 104 for machining. The tension for the temporary holding of the part between the left hand jaw 105 and the central jaw 104 is adjustable by adjusting the pressure exerted by the friction plates 307 on the base surface 308. The tension of the friction plates is determined by the tension on the springs 611 which is adjusted using the set screws 610 that fit through threaded holes (shown but not numbered) on the right hand truck 302. In another embodiment (not shown) there is a single friction plate 307 rather than the two friction plates shown in the figure.

SUMMARY

A two-station self-centering vise to hold a pair of work pieces is described. The pieces are held in place against a centered fixed jaw, being clamped against the centered fixed jaw by a pair of movable jaws located on either side of the centered jaw and that simultaneously move toward or away from the centered jaw on actuation of a lead screw. The vise may be converted to a single station vise by removable of the fixed center jaw. A spring loaded, adjustable, friction pad attached to the base of one of the two movable jaws enables temporary clamping of a first work piece while the second workpiece is being installed and once both workpieces are in place the lead screw is turned further to securely and accurately hold the workpieces in between the movable jaws and the fixed central jaw.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A convertible two station vise comprising:

a) a rectangular base (102) having a length, a long axis and a short axis, the short axis perpendicular to the long axis and a U-shaped channel on a top surface of the base, the channel running the length of the base and parallel to the long axis of the base, the channel having two vertical walls and grooves cut in the vertical walls, the grooves parallel to the long axis of the base, and, b) a first (302) and a second (401) movable truck, the trucks each having two side edges and projections from each side edge, the projections fit into the grooves in the vertical walls of the U-shaped channel of the base, the projections slide in the grooves and the trucks thereby move along the U-shaped channel of the base in a direction parallel to the long axis of the base, and, c) a first (103) and second (105) L-shaped movable jaw, both the first and second L-shaped moveable jaws each including a first dovetail groove (501, 502, 505, 506) along both sides of a top of each jaw, and both the first and second L-shaped moveable jaws are each bolted to the first and second movable trucks respectively, and, d) a single fixed jaw (104) removably attached to the base and centrally located between the first and second L-shaped movable jaws, the fixed jaw including a pair of second dovetail grooves (503, 504) on either side that are parallel to the dove tail grooves on the first and second movable jaws such that a first workpiece and a second workpiece may be simultaneously clamped between the first and second movable jaws and the central fixed jaw respectively, and, e) a lead screw (112) having a first end with right hand threads and a second end with left hand threads and the ends separated by a raised stop (601), the raised stop located at the center of the lead screw, and, the raised stop is a raised cylindrical region on the lead screw, and, f) the first end of the lead screw fitted to a threaded hole on the first truck (302) and the second end of the lead screw fitted to a threaded hole on the second truck (401) such that rotation of the lead screw causes the trucks and the attached movable jaws to simultaneously move along the lead screw towards or away from the centrally located fixed jaw, and, g) a friction plate (307) attached to a bottom surface of the first truck by two set screws (610) with springs around each of the two set screws that presses the friction plate against a top surface of the U-shaped channel, thereby providing a resistance to movement of the first truck and causing the second truck to make a first contact with the fixed central jaw thereby temporarily clamping a workpiece between the second jaw the fixed central jaw while the first truck continues to move by rotation of the lead screw, and, h) a tension for the temporary clamping of the workpiece between the second jaw and the fixed central jaw is adjustable by adjusting a pressure exerted by the friction plate against the top surface of the U-shaped channel, the pressure exerted by the friction plate is determined by a tension on the springs around each of the two set screws, and, the tension is adjusted using the two set screws.

* * * * *